US011889874B2

(12) United States Patent
Yanagisawa et al.

(10) Patent No.: US 11,889,874 B2
(45) Date of Patent: Feb. 6, 2024

(54) WEARABLE AIRBAG DEVICE

(71) Applicant: TOYODA GOSEI CO., LTD., Kiyosu (JP)

(72) Inventors: Toshihito Yanagisawa, Kiyosu (JP); Yusuke Kawamura, Kiyosu (JP); Wataru Miura, Kiyosu (JP); Motoyuki Tanaka, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 17/581,426

(22) Filed: Jan. 21, 2022

(65) Prior Publication Data

US 2022/0273054 A1 Sep. 1, 2022

(30) Foreign Application Priority Data

Feb. 26, 2021 (JP) ..... 2021-30655

(51) Int. Cl.
*A41D 13/018* (2006.01)
*A41D 13/05* (2006.01)

(52) U.S. Cl.
CPC ..... *A41D 13/018* (2013.01); *A41D 13/0506* (2013.01)

(58) Field of Classification Search
CPC ..... A41D 13/018; A41D 13/0506; A41D 13/002; A41D 13/0155; A63B 29/021
USPC ..... 2/455
See application file for complete search history.

(56) References Cited

U.S. PATENT DOCUMENTS 3,243,822 A * 4/1966 Lipkin ..... A41D 13/018 280/730.1
3,921,944 A * 11/1975 Morrison ..... A62B 1/22 2/456
4,379,705 A * 4/1983 Saotome ..... B63C 9/155 441/108
4,626,221 A * 12/1986 Rocco ..... B63C 9/155 441/108
4,635,754 A * 1/1987 Aschauer ..... A62B 33/00 441/93

(Continued)

FOREIGN PATENT DOCUMENTS

EP 3 662 772 A1 6/2020
JP 2007-518885 A 7/2007

(Continued)

OTHER PUBLICATIONS

Office Action dated Aug. 28, 2023 issued in corresponding JP patent application No. 2021-030655 (and English machine translation).

*Primary Examiner* — Heather Mangine
*Assistant Examiner* — Raquel M. Weis
(74) *Attorney, Agent, or Firm* — POSZ LAW GROUP, PLC

(57) ABSTRACT

A wearable airbag device that is adapted to be worn by a wearer for protecting one or more targeted body parts of the wearer. The airbag device includes an airbag that includes one or more protecting inflatable portions each of which is configured to be inflated with an inflation gas and cover one of the one or more targeted body parts, and a means for preventing each of the protecting inflatable portions from being dislocated from the targeted body part at airbag deployment.

4 Claims, 16 Drawing Sheets

(56) References Cited

U.S. PATENT DOCUMENTS 4,637,074 A * 1/1987 Taheri ..... A41D 13/018 2/456
4,737,994 A * 4/1988 Galton ..... A41D 13/0506 2/DIG. 3
5,368,512 A * 11/1994 Brown ..... B63C 9/155 441/108
5,500,952 A * 3/1996 Keyes ..... A41D 13/018 2/908
5,781,936 A * 7/1998 Alaloof ..... A41D 13/018 2/456
5,867,842 A * 2/1999 Pinsley ..... A41D 13/018 2/463
5,937,443 A * 8/1999 Kageyama ..... A41D 13/018 2/455
6,158,380 A * 12/2000 Aschauer ..... A62B 99/00 116/210
6,220,909 B1 * 4/2001 Aschauer ..... A63B 29/021 441/80
6,859,939 B1 * 3/2005 Osburn, Sr. ..... A41D 13/018 128/869
7,017,195 B2 * 3/2006 Buckman ..... A61B 5/1117 2/455
8,998,667 B2 * 4/2015 Malcom ..... B63C 9/155 441/92
9,027,170 B2 * 5/2015 Dainese ..... B62J 27/20 2/455
9,107,615 B2 * 8/2015 Buckman ..... G01C 19/04
9,371,119 B2 * 6/2016 Malcom ..... B63C 9/1255
9,439,460 B2 * 9/2016 Richards ..... A41D 13/0007
9,629,399 B2 * 4/2017 Raanan ..... A41D 13/0506
10,238,918 B1 * 3/2019 Huot ..... A45F 3/04
2002/0078484 A1 * 6/2002 Ulert ..... A41D 13/0506 2/22
2002/0175499 A1 * 11/2002 Mattes ..... A41D 13/018 280/728.1
2004/0003455 A1 * 1/2004 Davidson ..... A41D 13/018 2/455
2005/0067816 A1 * 3/2005 Buckman ..... A41D 13/018 280/730.1
2006/0049950 A1 * 3/2006 Lockhart ..... G08B 21/0446 340/573.1
2006/0107952 A1 * 5/2006 Schlosser ..... A41D 13/018 128/202.19
2006/0218706 A1 10/2006 Mazzarolo
2006/0288464 A1 * 12/2006 Warden ..... A41D 13/018 2/69
2007/0056500 A1 * 3/2007 Beck ..... A63B 29/021 116/210
2007/0117479 A1 * 5/2007 Weinel ..... A62B 33/00 441/117
2008/0173764 A1 * 7/2008 Oh ..... B64D 17/40 244/143
2008/0257643 A1 * 10/2008 Weinel ..... A62B 33/00 182/18
2010/0255809 A1 * 10/2010 Aschauer ..... A63B 29/021 455/404.2
2013/0276213 A1 10/2013 Olsson et al.
2013/0312168 A1 * 11/2013 Raanan ..... A61B 5/6831 2/465
2014/0047624 A1 * 2/2014 Richards ..... A41D 13/0155 2/455
2014/0123374 A1 * 5/2014 Gelston ..... A41D 13/018 2/455
2015/0101112 A1 * 4/2015 Balbien ..... A41D 13/018 2/455
2016/0000158 A1 * 1/2016 Davis ..... A63B 69/18 2/455
2016/0015094 A1 * 1/2016 Walker ..... B63C 9/18 441/80
2016/0016045 A1 * 1/2016 Rose ..... A62B 33/00 441/114
2016/0206924 A1 * 7/2016 Schaer ..... A63B 29/00
2017/0224031 A1 * 8/2017 Raanan ..... A61B 5/6831
2017/0274229 A1 * 9/2017 Werz ..... A62B 33/00
2017/0281056 A1 * 10/2017 Raanan ..... A61B 5/6831
2018/0140875 A1 * 5/2018 Navez ..... A63B 29/021
2019/0069612 A1 * 3/2019 Hyde ..... H01H 35/14
2019/0150532 A1 * 5/2019 Weinstein ..... A45F 3/005
2019/0269181 A1 * 9/2019 Bae ..... A41D 13/018
2020/0329789 A1 * 10/2020 Cholhan ..... A41D 13/018
2021/0235787 A1 * 8/2021 Jeandupeux ..... A61B 5/1117

FOREIGN PATENT DOCUMENTS

JP 2013-540209 A 10/2013
JP 2015-62545 A 4/2015
JP 2019-163574 A 9/2019
WO WO-2018048060 A1 * 3/2018 ..... A41D 13/018
WO 2019/207474 A1 10/2019

* cited by examiner

WEARABLE AIRBAG DEVICE

CROSS REFERENCE TO RELATED APPLICATIONS

The present application claims priority from Japanese Patent Application No. 2021-30655 of Yanagisawa et al., filed on Feb. 26, 2021, the entire disclosure of which is incorporated herein by reference.

BACKGROUND

1. Technical Field

The present disclosure relates to a wearable airbag device that is adapted to be worn by a wearer and configured to protect a targeted body part of the wearer.

2. Description of Related Art

WO2019/207474 A1 discloses a wearable airbag device that is adapted to be wrapped around the waist of a wearer and configured to deploy an airbag downward to protect the hip of the wearer.

JP2015-62545 A discloses a wearable airbag device that is formed into a jacket wearable on the upper body of a wearer and configured to inflate an airbag to protect the upper body of the wearer.

The wearable airbag devices disclosed in the above literatures are sometimes worn by the wearer in a state in which the airbag is dislocated from the targeted body part. Thus, there is a room for improvement in deploying an airbag so the airbag protects the targeted body part adequately.

SUMMARY

An exemplary embodiment of the present disclosure relates to a wearable airbag device that is adapted to be worn by a wearer for protecting one or more targeted body parts of the wearer. The airbag device includes: an airbag that is formed of a sheet material having flexibility, the airbag including one or more protecting inflatable portions each of which is configured to be inflated with an inflation gas and to cover one of the one or more targeted body parts; and a means for preventing each of the one or more protecting inflatable portions from being dislocated from the targeted body part at airbag deployment.

BRIEF DESCRIPTION OF DRAWINGS

FIG. 6 is a schematic horizontal sectional view of the left portion of the airbag.

DETAILED DESCRIPTION

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Figure 1:
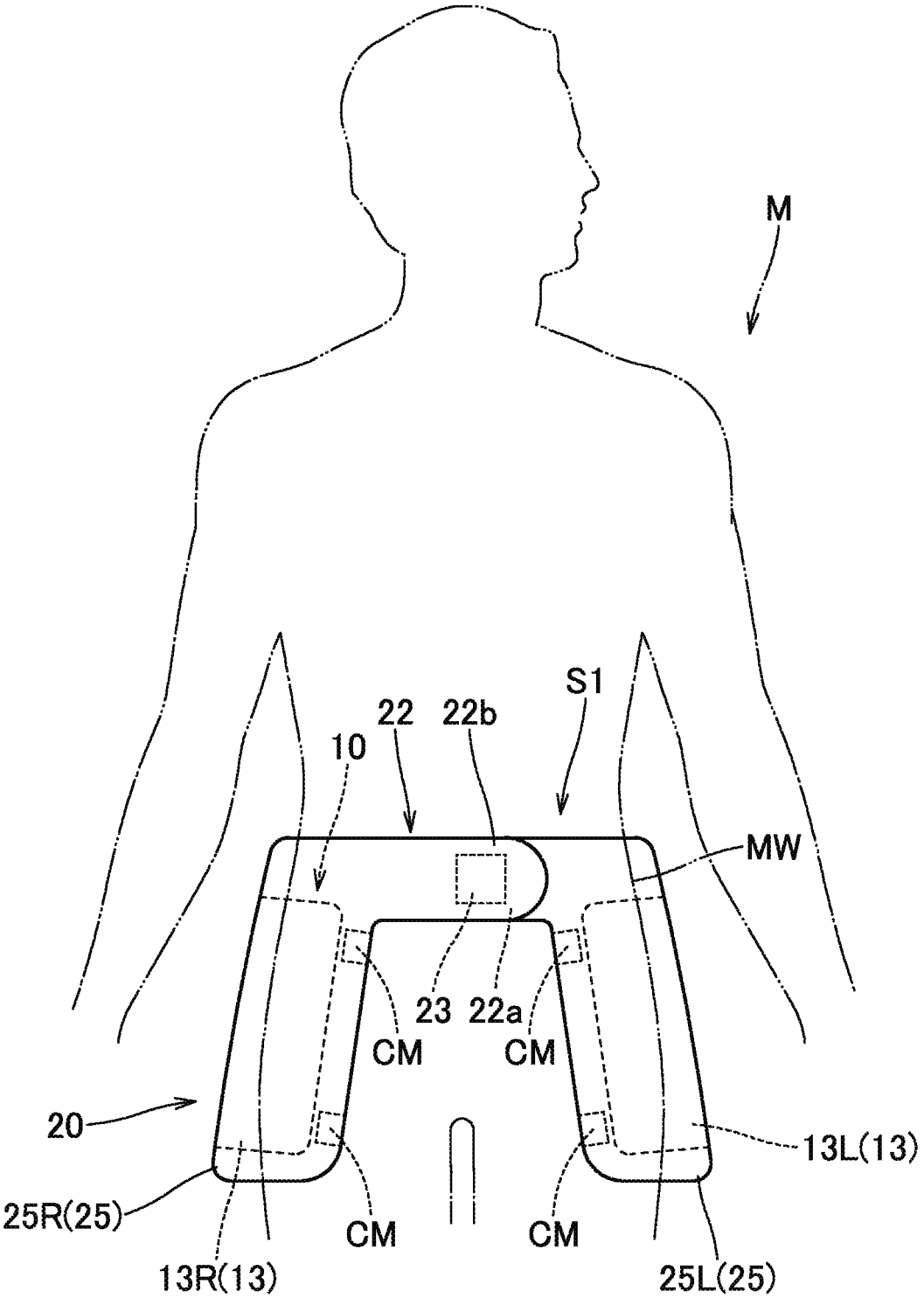
FIG. 1 schematically depicts a wearable airbag device in accordance with an exemplary embodiment as worn by a wearer.

A wearable airbag device S1 in accordance with the exemplary embodiment is configured to be wrapped around the hip MW (more particularly, around the pelvis MP) of a wearer M, as can be seen in FIG. 1. Unless otherwise specified, up-down, front-rear, and left-right directions in the following description are intended to refer to up-down, front-rear, and left-right directions as viewed from the wearer M wearing the airbag device S1.

Figure 2:
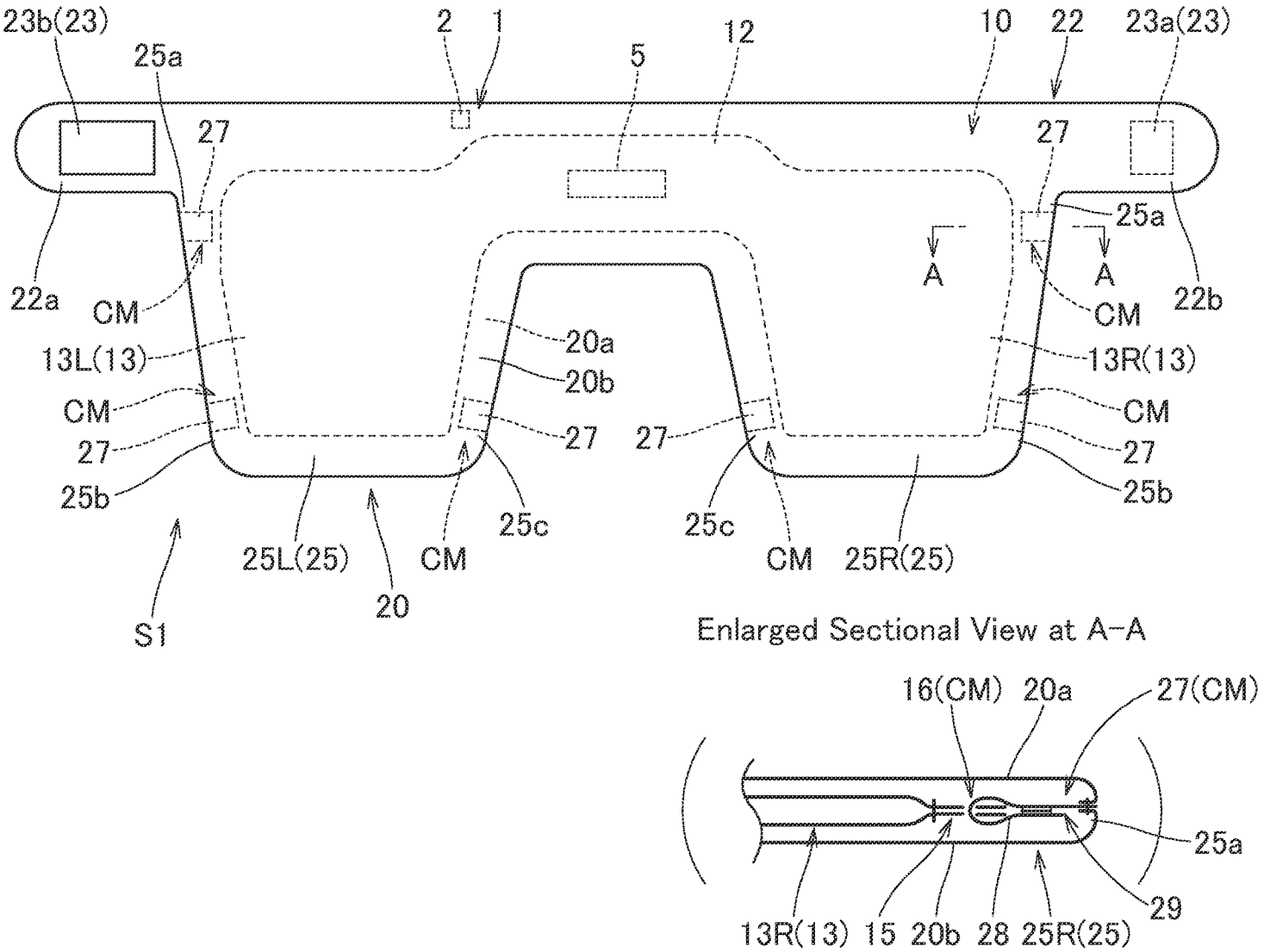
FIG. 2 is a plan view of the wearable airbag device of the exemplary embodiment as laid flat.

As can be seen in FIGS. 1 and 2, the wearable airbag device S1 includes an airbag 10, a gas generator 5 for feeding the airbag 10 with an inflation gas, an operation control device 1 that includes a sensor part 2 for detecting a fall of the wearer M and is configured to actuate the gas generator 5, an outer cover 20 that covers an outer circumference of the airbag 10, and a means CM for connecting the airbag 10 and the outer cover 20 together, namely, a connecting means or slippage-preventing means. In the wearable airbag device S1 in accordance with the exemplary embodiment, the airbag 10 is disposed inside the outer cover 20 in a developed or unfolded state.

The operation control device 1 includes a sensor part 2 that includes an angular velocity sensor capable of sensing angular velocities around three axes in up and down, front and rear, and left and right directions, and an acceleration sensor capable of sensing accelerations in the three-axis directions. The operation control device 1 is configured to actuate the gas generator 5 in response to a signal fed from the sensor part 2 as has sensed a falling behavior different from a normal behavior of the wearer M. More particularly, the operation control device 1 includes a determining means that is configured to determine based on various thresholds, and is configured to actuate the gas generator 5 upon sensing a fall of the wearer M based on the determination by the determining means. The operation control device 1 further includes a power source composed of a not-shown battery or the like for operation of the sensor part 2 and for emission of an actuating signal to the gas generator 5.

The airbag 10 is made of a sheet material having flexibility. The airbag 10 of this specific embodiment is made of a fabric woven with polyester yarns, polyamide yarns or the like. The airbag 10 is adapted to be worn by the wearer M in such a manner as to be wrapped around the pelvis MP through the use of a later-described wrap portion 22 of the outer cover 20. As can be seen in FIG. 1, the airbag 10 of this embodiment is configured to cover left and right sides of the hip MW of the wearer M when worn. As can be seen in FIG. 2, the airbag 10 includes an inner wall 10*a* that is configured to be disposed towards the wearer M (i.e. in the inner side) when worn, and an outer wall 10*b* that is substantially identical to the inner wall 10*a* in outer shape and configured to be disposed on the outer side when worn, and is formed into a bag inflatable into a substantially board shape by sewing (joining) circumferential edges of the inner wall 10*a* and outer wall 10*b* together. As can be seen in FIGS. 1 and 2, the airbag 10 of this embodiment includes two protecting inflatable portions 13 (13L, 13R) for covering left and right sides of the hip MW of the wearer M at airbag deployment, and a communicating path 12 that provides gas communication between upper ends regions 13*a* of the two protecting inflatable portions 13. The airbag 10 is designed to be bilaterally symmetrical in shape as laid flat.

The communicating path 12 is designed to be inflated into a rod shape elongated substantially along a left and right direction. The communicating path 12 is disposed inside the later-described wrap portion 22 of the outer cover 20. Although not depicted in detail, the communicating path 12 of this embodiment is adapted to be disposed at the rear of the pelvis MP of the wearer M at airbag deployment. In this specific embodiment, the gas generator 5 is connected to the communicating path 12 for feeding the airbag 10 with an inflation gas, as can be seen in FIG. 2. Although not depicted in detail, the gas generator 5 is located at a vicinity of the center in the length direction of the communicating path 12. The gas generator 5 contains a compressed gas in a sealed state, and is designed to discharge a cold gas into the airbag 10 when actuated and unsealed. The gas generator 5 is electrically connected to the operation control device 1 and configured to be actuated when fed with an actuating signal from the operation control device 1 as has sensed a fall of the wearer M.

Figure 3:
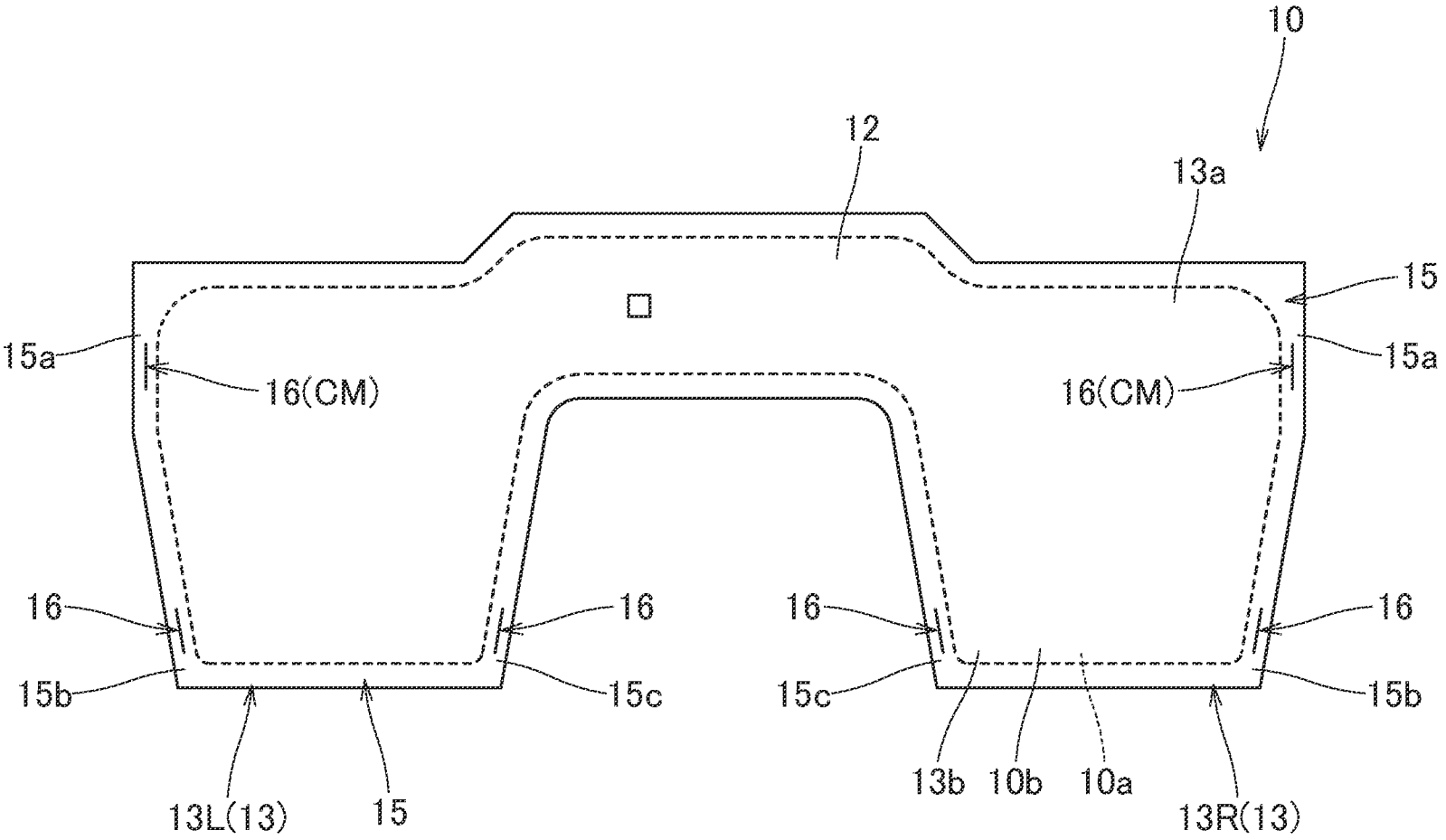
FIG. 3 is a plan view of an airbag for use in the wearable airbag device of the exemplary embodiment as laid flat.
Figure 6:
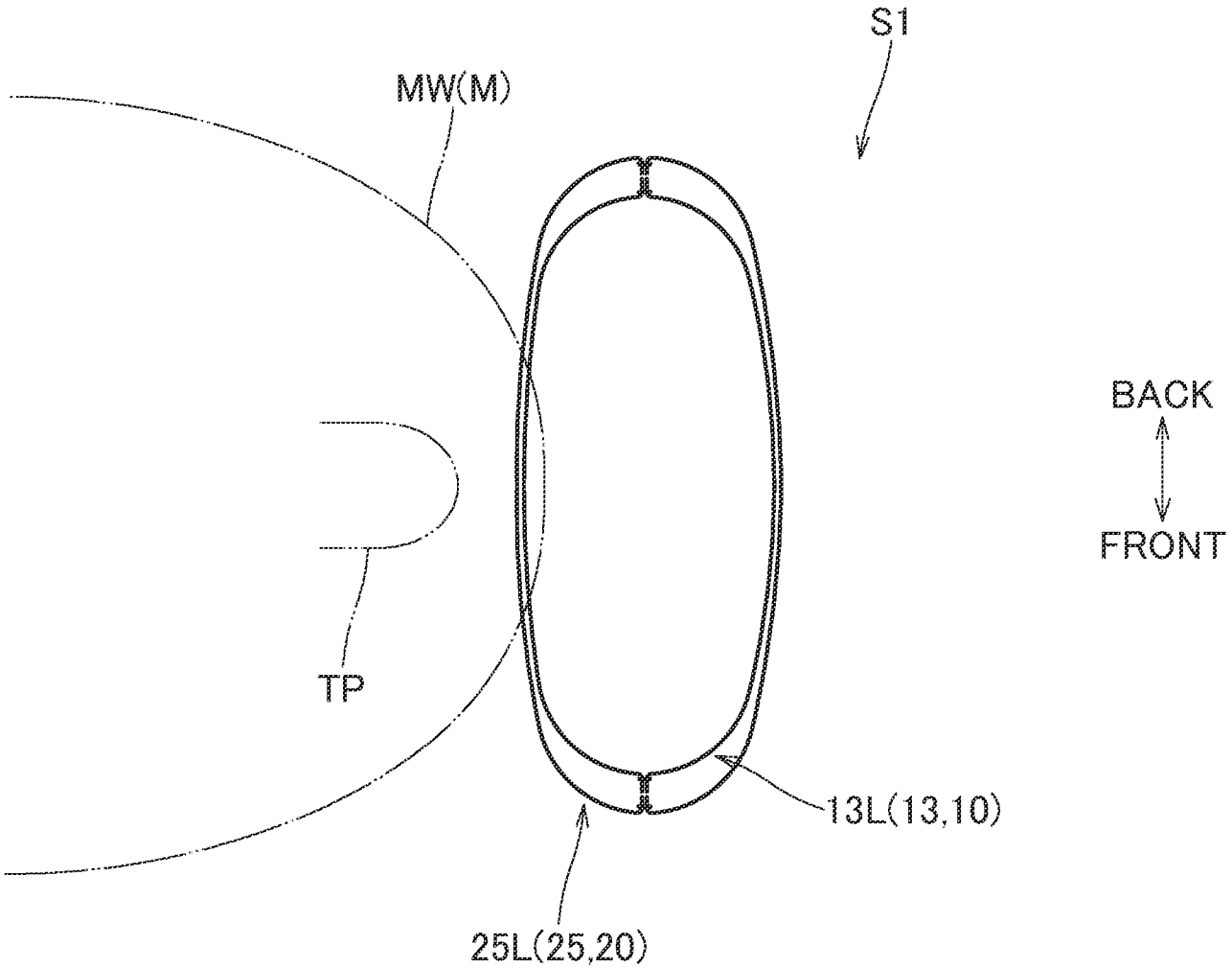
FIG. 6 is a schematic partial horizontal sectional view of the airbag of FIG. 3 as deployed in the worn state taken along a front and rear direction in the wearable airbag device of the exemplary embodiment. More particularly.
Figure 7:
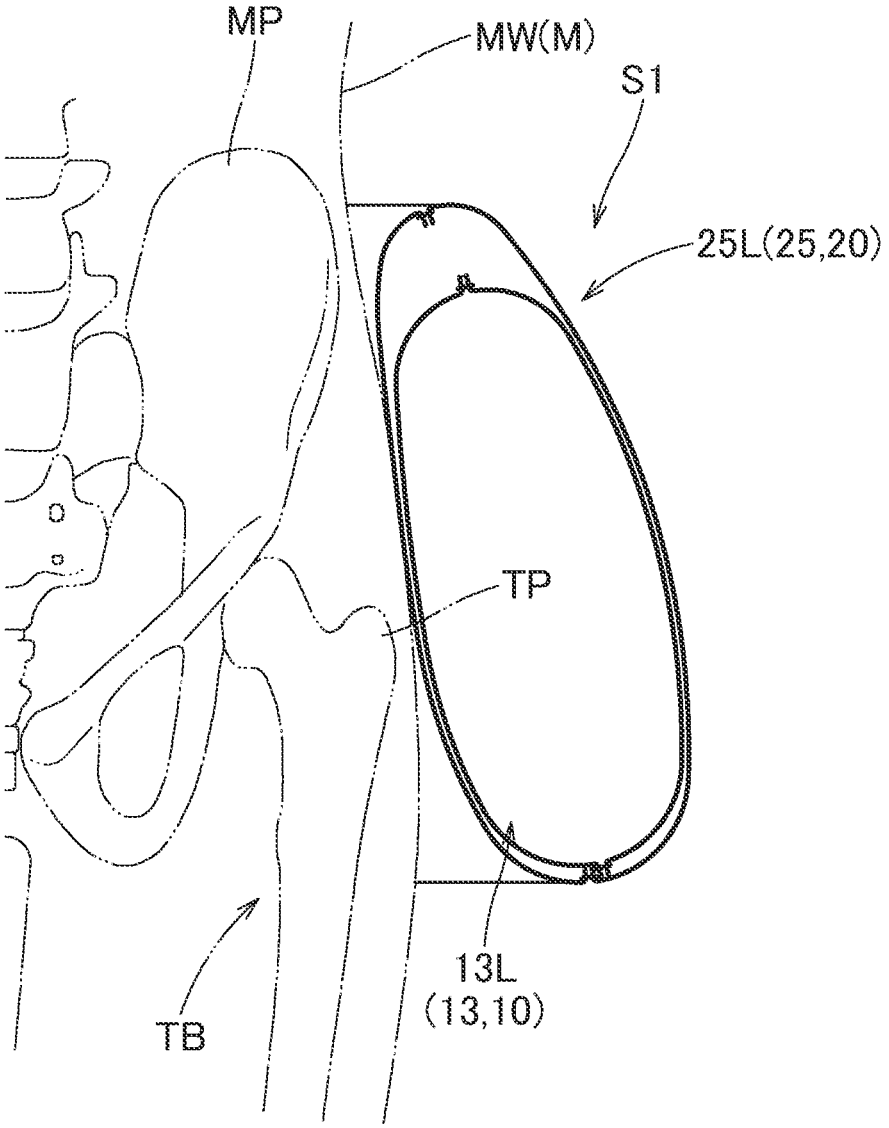
FIG. 7 is a schematic vertical sectional view of the airbag of FIG. 3 as deployed in the worn state.

As can be seen in FIGS. 2 and 3, in the airbag 10 as laid flat, each of the protecting inflatable portions 13 (13L, 13R) of this embodiment is designed such that the upper edge 13*a* is disposed at a slightly farther downward position than the upper edge of the communicating path 12, in a stepped manner with respect to the communicating path 12. The protecting inflatable portions 13 (13L, 13R) are designed to extend downward and outwardly in the left and right direction from the communicating path 12, in the airbag 10 as laid flat. In order to cover the trochanter (greater trochanter) TP of femur and surroundings as a targeted body part amply when worn, each of the protecting inflatable portions 13 as laid flat has a substantially trapezoidal outer shape that has a greater width in a front and rear direction than that in an up and down direction, and slightly narrows toward the lower end 13*b*. More particularly, as can be seen in FIGS. 6 and 7, each of the protecting inflatable portions 13 is configured to cover the body part ranging from a side of the pelvis MP to the subtrochanteric region amply at airbag deployment.

The airbag 10 of this embodiment includes, in a circumferential portion 15 forming an outer circumferential edge of each of the protecting inflatable portions 13 (13L, 13R), which is an uninflatable region, one or more through holes 16 for receiving a later-described connecting belt 27 formed in the outer cover 20. In this specific embodiment, the through holes 16 are located in a vicinity of each of the three corners of each of the protecting inflatable portions 13 (13L, 13R) except the upper rear corner in a vicinity of the communicating path 12. More particularly, the through holes 16 are located in a vicinity of the upper front edge 15*a*, in a vicinity of the lower front edge 15*b*, and in a vicinity of the lower rear edge 15*c* of each of the protecting inflatable portions 13 (13L, 13R) in the circumferential portion 15. Each of the through holes 16 is formed into a slit extending substantially in the up and down direction, as can be seen in FIG. 3.

The outer cover 20 is made of a flexible woven fabric having better touch than the base cloths of the airbag 10. The outer cover 20 of this embodiment is formed of a woven fabric of polyester. The outer cover 20 includes an inner wall 20*a* that is disposed in the inner side (i.e. towards the wearer M) when worn, and an outer wall 20*a* that is substantially identical to the inner wall 20*b* in outer shape and disposed on the outer side when worn, and is formed into a bag by joining (or sewing) outer circumferential edges of the inner wall 20*a* and outer wall 20*b* together. The outer cover 20 is slightly greater than the airbag 10 in outer shape as laid flat so as to allow the airbag 10 to inflate smoothly there inside. Referring to FIG. 2, the outer cover 20 includes a wrap portion 22 that is substantially band-shaped, located in a vicinity of the upper edge of the outer cover 20 and is adapted to be wrapped around the body part above the pelvis MP of the wearer M, and two covering portions 25 (25L, 25R) each of which extends downward from the wrap portion 22 for covering an outer circumference of the protecting inflatable portion 13 (13L/13R). The wrap portion 22 includes, at the opposite ends 22*a*, 22*b*, a surface fastener or hook-and-loop fastener 23 serving as a means for placing the airbag device S1 (i.e. the outer cover 22) on the body of the wearer M (namely, a placing means). The hook-and-loop fastener 23 includes a pair of a hook surface 23*a* and a loop surface 23*b* that are respectively disposed on the opposite ends 22*a*, 22*b* of the wrap portion 22 for fastening the opposite ends 22*a*, 22*b* together. Each of the covering portions 25 (25L, 25R) as laid flat has such a shape that is substantially similar to and greater than that of each of the protecting inflatable portions 13 (13L, 13R) so as to allow the protecting inflatable portion 13 to inflate smoothly there inside.

Figure 4:
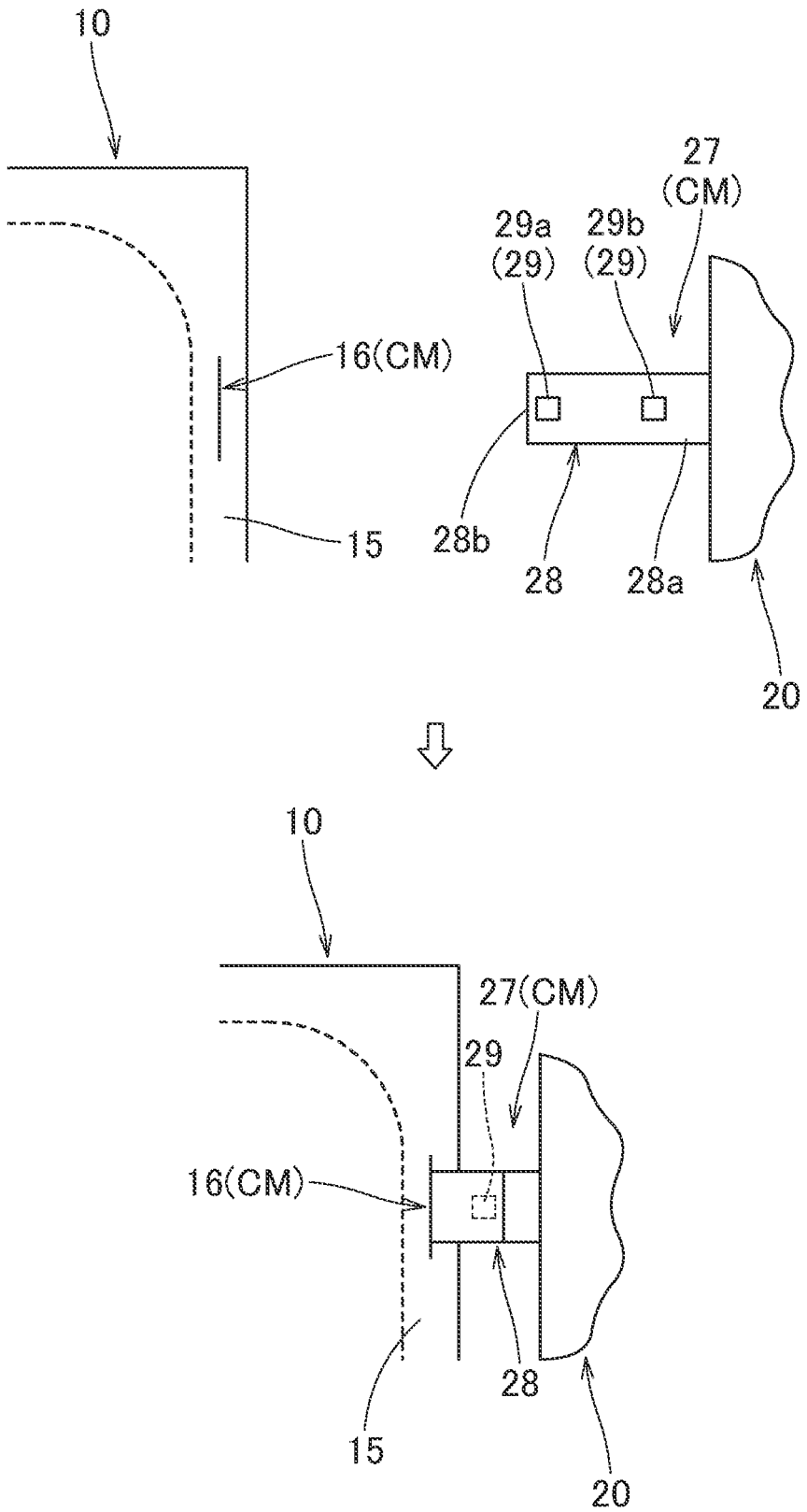
FIG. 4 schematically depicts the way the airbag and an outer cover are coupled together through the use of a connecting means.

The outer cover 20 internally includes one or more connecting belts 27 as passing members that are connected to the circumferential portion 15 of each of the protecting inflatable portions 13 of the airbag 10. The connecting belts 27 are located at three positions, in a vicinity of the upper front edge 25*a*, in a vicinity of the lower front edge 25*b*, and in a vicinity of the lower rear edge 25*c*, of each of the covering portions 25 (25L, 25R) of the outer cover 20, corresponding to the locations of the through holes 16 formed in the circumferential portion 15 of each of the protecting inflatable portions 13. Each of the connecting belts 27 includes a belt body 28 that extends from an edge of the outer cover 20 and is passed through the through hole 16, and a surface fastener or hook-and-loop fastener 29 as a fastening means that fastens the base portion 28*a* and leading end portion 28*b* of the belt body 28 together in order to connect the connecting belt 27 to a periphery of the through hole 16. The hook-and-loop fastener 29 is composed of a hook-side surface 29*a* and a loop-side surface 29*b* that are engageable or interlockable with one another and respectively located at the base portion 28*a* and leading end portion 28*b* of the belt body 28. By fastening together the hook-side surface 29*a* and loop-side surface 29*b* in the belt body 28 as passed through the through hole 16, each of the belt bodies 28 is connected to the circumferential portion 15 of each of the protecting inflatable portions 13 of the airbag 10, as can be seen in FIGS. 2 and 4.

The wearable airbag device S1 in accordance with the exemplary embodiment includes, as the connecting means CM that connects the airbag 10 and outer cover 20 together, the through holes (airbag-side connecting means) 16 formed in the circumferential portion (i.e. the uninflatable portion) 15 of each of the protecting inflatable portions 13 and the connecting belts (outer-cover-side connecting means) 27 disposed in the inner surface of each of the covering portions 25. The connecting means CM positions the three portions in the vicinities of three corners of each of the protecting inflatable portions 13 except the corner in a vicinity of the communicating portion 12 with respect to the covering portion 25 of the outer cover 20. That is, the connecting means CM connects each of the protecting inflatable portions 13 to each of the covering portions 25 of the outer cover 20 while positioning with respect to the outer cover 20, thus prevents the airbag 10 from being dislocated from the outer cover 20.

Figure 5:
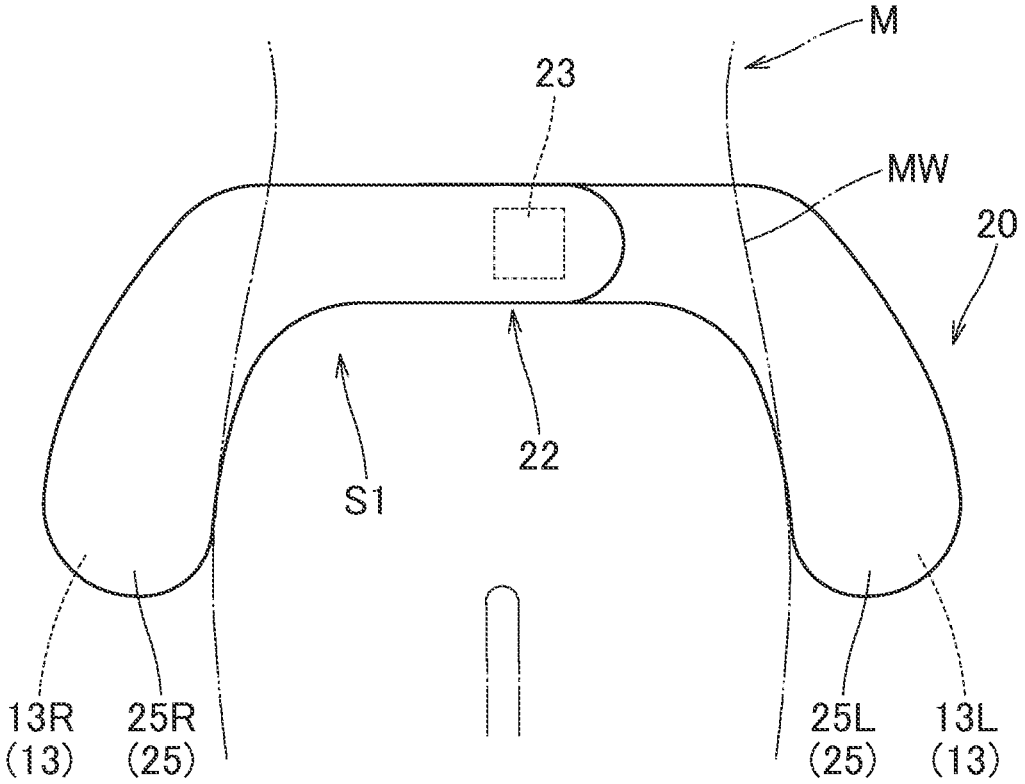
FIG. 5 schematically depicts the wearable airbag device as has deployed the airbag in a worn state.

The wearable airbag device S1 in accordance with the exemplary embodiment is put on around the hip MW (pelvis MP) of the wearer M by fastening the opposite ends 22*a*, 22*b* of the wrap portion 22 of the outer cover 20 together with the use of the hook-and-loop fastener 23, as can be seen in FIG. 1. If the sensor part 2 detects a falling behavior of the wearer M as wearing the airbag device S1, the operation control device 1 sends an actuating signal to the gas generator 5, the gas generator 5 feeds an inflation gas to the airbag 10, so that the airbag 10 is deployed as shown in FIGS. 5 to 7.

At this time, the connecting means CM as the slippage-preventing means prevents each of the protecting inflatable portions 13 of the airbag 10 from being dislocated from the trochanter TP as the targeted body part so the protecting inflatable portion 13 covers and protects the trochanter TP accurately and adequately.

Therefore, the wearable airbag device S1 in accordance with the exemplary embodiment is able to protect the trochanters TP as the targeted body parts adequately at airbag deployment by preventing the airbag 10 from being dislocated with respect to the wearer M.

Particularly, the wearable airbag device S1 in accordance with the exemplary embodiment includes the airbag 10 and outer cover 20 that covers an outer circumference of the airbag 10. The airbag device S1 is configured to be put on the wearer M with the use of the hook-and-loop fastener as the placing means 23 formed in the outer cover 20. The connecting means CM as the slippage-preventing means is configured to prevent the airbag 10 from being dislocated with respect to the outer cover 20. The connecting means CM as the slippage-preventing means will enable the wearable airbag device S1 to be put on the wearer M in a state in which the airbag 10 is prevented from being dislocated with respect to the outer cover 20. The connecting means CM as the slippage-preventing means will also prevent the airbag 10 from being dislocated inside the outer cover 20 when the wearer M wearing the airbag device S1 moves. Moreover, since the airbag 10 is covered by the outer cover 20 by the outer circumference, the wearable airbag device S1 as worn has a good external appearance.

Even more particularly, in the wearable airbag device S1 in accordance with the exemplary embodiment, the connecting means CM connects one or more predetermined portions of the airbag 10 to the outer cover 20 while fixing the predetermined portions in position in the outer cover 20. As the connecting means CM, the through holes 16 are formed in the airbag 10 as the airbag-side connecting means in such a manner as to go through the circumferential portion (i.e. uninflatable portion) 15 of each of the protecting inflatable portions 13, and the connecting belts 27 are disposed in the outer cover 20 as the outer-cover-side connecting means. Each of the connecting belts 27 as the passing members is passed through one of the through holes 16 to fix the peripheral region of the through hole 16 in position. With this configuration, if each of the mounting belts 27 disposed in the outer cover 20 is passed through one of the through holes 16 in the airbag 10 and tied to itself in a vicinity of the through hole 16, the peripheral region of the through hole 16 is fixed in position, i.e. the airbag 10 is fixed in position with respect to the outer cover 20. The above configuration will facilitate this connecting work. In the above exemplary embodiment, the connecting belts 27, each of which includes the belt body 28 and the hook-and-loop fastener (connecting means) 29 disposed at the base portion 28*a* and leading end portion 28*b* of the belt body 28, are used as the passing members. Each of the connecting belts 27 is passed through one of the through holes 16 by the belt body 28, and tied to itself with the use of the hook-and-loop fastener 29, in order to fix the peripheral region of the through hole 16 in position with respect to the outer cover 20. The passing member should not be limited to those disclosed in the disclosure, though. By way of example, the passing member may alternatively be composed of a button that would be able to be passed through the through hole and retained by the peripheral region of the through hole, or a string that would be able to be passed through the through hole and knotted in a vicinity of the peripheral region of the through hole.

Figure 8:
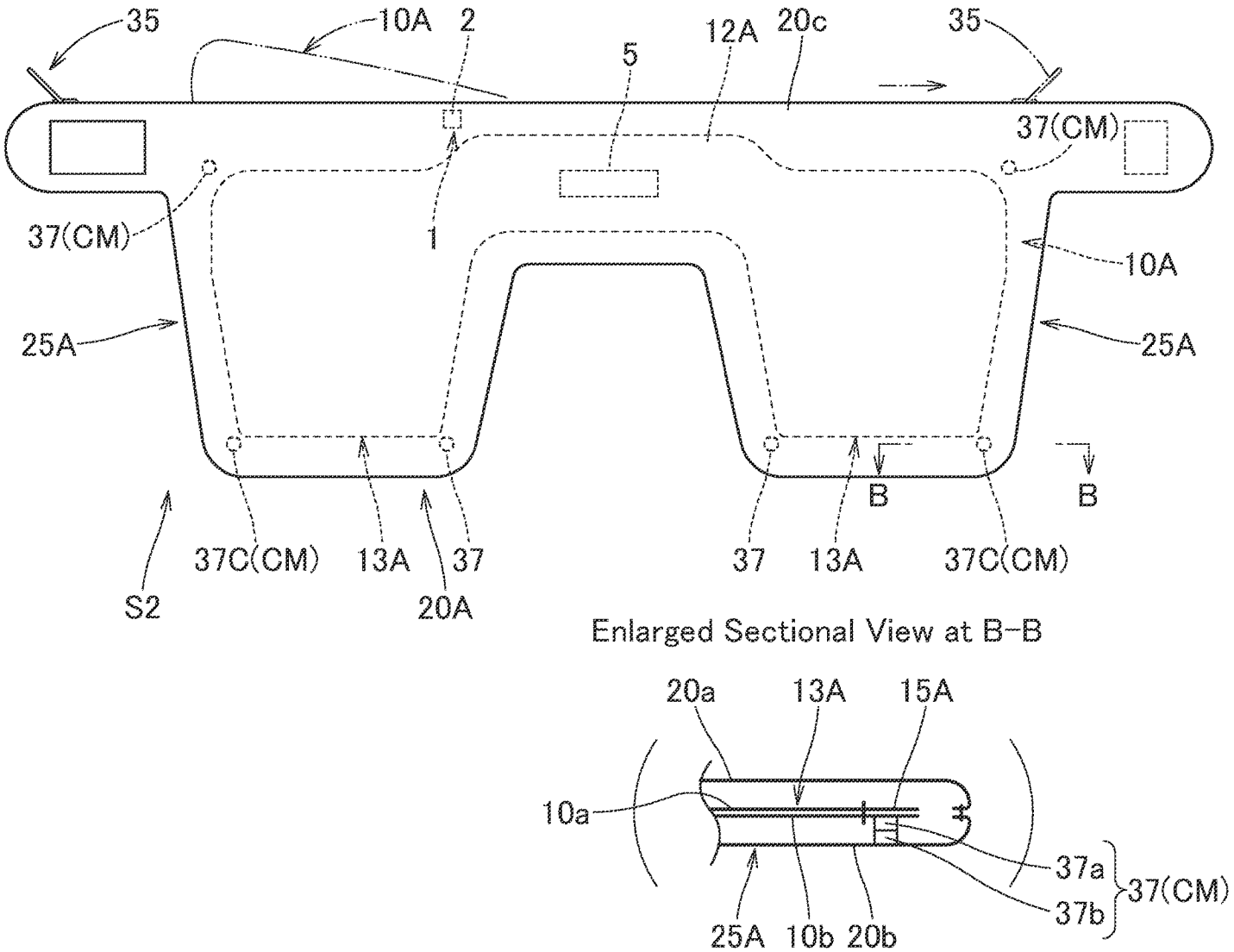
FIG. 8 is a plan view of a wearable airbag device in accordance with an alternative embodiment as laid flat.

The wearable airbag device may be configured like a wearable airbag device S2 depicted in FIG. 8. The wearable airbag device S2 includes an airbag 10A, a gas generator 5 for feeding the airbag 10A with an inflation gas, an operation control device 1 that includes a sensor part 2 for detecting a fall of the wearer M and is configured to actuate the gas generator 5, an outer cover 20A that covers an outer circumference of the airbag 10A, and an interlocking means 37 that serves as the means CM for connecting the airbag 10A and the outer cover 20A (i.e. connecting means CM). In the wearable airbag device S2, the operation control device 1 and the gas generator 5 have the same configurations as those of the airbag device S1 of the foregoing embodiment, respectively, and therefore, detailed description for those will be omitted. The wearable airbag device S2 has substantially similar configurations to the airbag device S1 of the foregoing embodiment except in having the interlocking means 37 as the connecting means CM and except in that the outer cover 20A is configured to be openable at the upper edge 20*c*. Therefore, each of the common members will be assigned "A" at the end of the common reference sign, and the descriptions of those members will be omitted. In the wearable airbag device S2, the outer cover 20A is configured to be openable by an entirety of the length of the upper edge 20*c* with such a fastening member 35 as a zip faster.

The interlocking means 37 that serves as the means CM for connecting the airbag 10A and the outer cover 20A is composed of a pair of interlockable or engageable parts that are respectively disposed in the outer surface of the airbag 10A and in the inner surface of the outer cover 20A. In this specific embodiment, the interlocking means 37 is composed of a snap button. Specifically, the interlocking means 37 includes a pair of a male part 37*a* and a female part 37*b* which are interlockable with one another. The male part 37*a* and female part 37*b* are respectively located in the outer surface of the outer wall 10*b* of each of the protecting inflatable portions 13A of the airbag 10A and in the inner surface of the outer wall 20*b* of each of the covering portions 25A of the outer cover 20A. More particularly, in a similar fashion to the connecting means CM in the airbag device S1 of the foregoing embodiment, the snap button is located at three positions in vicinities of the three corners of each of the protecting inflatable portions 13A in the circumferential portion 15A except the corner in a vicinity of the communicating path 12A.

With the configuration of the wearable airbag device S2, by making interlocked with one another each of the parts of the interlocking means 37 as the connecting means CM that are located in in the outer surface of the airbag 10A (protecting inflatable portion 13A) and in the inner surface of the outer cover 20A (covering portion 25A), the airbag 10A is fixed in position with respect to the outer cover 20A with a simple configuration. Although the interlocking means 37 of this specific embodiment is composed of snap buttons, the interlocking means should not be limited to those disposed in the disclosure. By way of example, the interlocking means may alternatively be composed of hook-and-loop fasteners or sets of hooks and eyes and so on.

In the wearable airbag device S2, the upper edge 20*c* of the outer cover 20A is configured to be openable with the fastening member 35 so the airbag 10A may be taken out of the outer cover 20A, as indicated with dashed-and-double-dotted lines in FIG. 8. This configuration enables washing of the outer cover 20A. Further, since the airbag 10A and outer cover 20A are joined together with the interlocking means 37 composed of the snap buttons, mounting and dismounting of the airbag 10A with respect to the outer cover 20A is easy.

In the wearable airbag device S1/S2, each of the connecting means CM is disposed at a position remote from the central region of each of the protecting inflatable portions 13/13A of the airbags 10/10A. Particularly, the connecting means CM is disposed in the circumferential portion 15/15A of each of the protecting inflatable portions 13/13A of the airbags 10/10A. Such connecting means CM is able to position and connect the airbag 10/10A to the outer cover 20/20A without affecting the protecting performance of the airbag 10/10A at protecting the targeted body parts (the trochanters TP). If such an advantageous effect does not have to be considered, the connecting means may be located in the central region of the protecting inflatable portion of the airbag.

In the wearable airbag device S1/S2 of the foregoing embodiments, especially, the connecting means CM are located in a vicinity of each of the three corners of each of the protecting inflatable portions 13/13A except the corner in a vicinity of the communicating path 12/12A. That is, each of the protecting inflatable portions 13/13A is joined to the outer cover 20/20A (i.e. to the covering portion 25/25A) by the vicinities of the four corners including the corner in the vicinity of the communicating path 12/12A which is configured to be inflated inside the wrap portion 22/22A of the outer cover 20/20A. This configuration will prevent each of the protecting inflatable portions 13/13A from being dislocated with respect to the covering portion 25/25A when worn as much as possible. Of course, the location and number of the connecting means should not be limited to those disclosed in the present disclosure. By way of example, the connecting means may be located only in upper regions of the airbag and outer cover, or only in lower regions of the airbag and outer cover.

Figure 9:
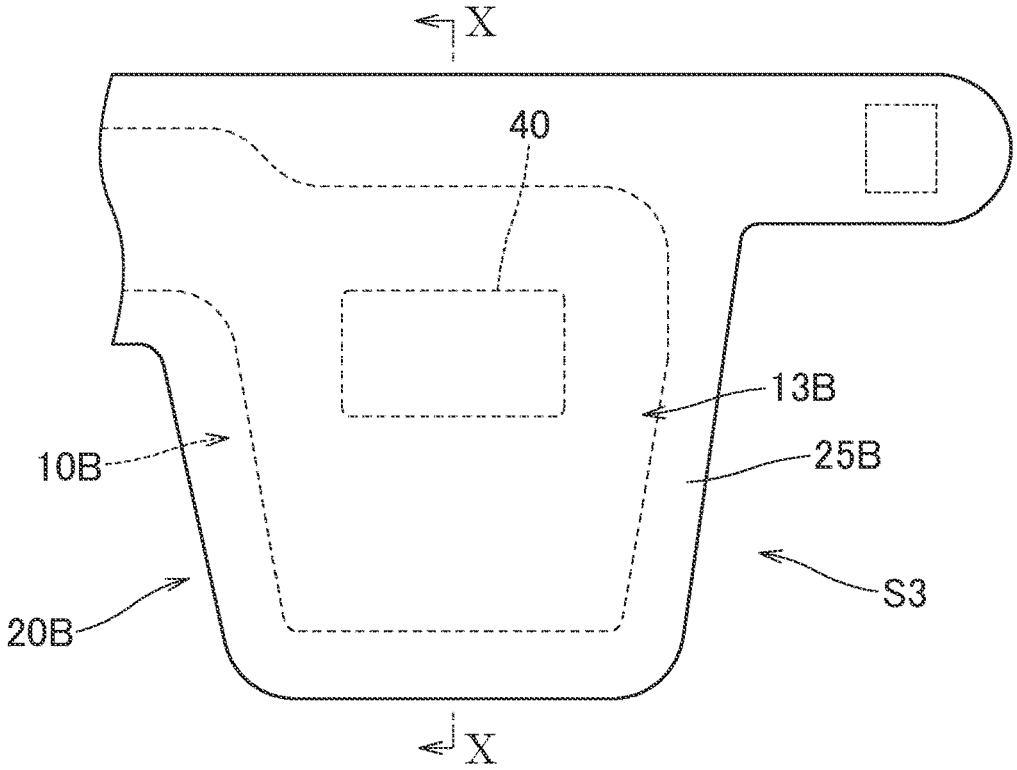
FIG. 9 is a partial enlarged plan view of a wearable airbag device in accordance with another alternative embodiment as laid flat.
Figure 10:
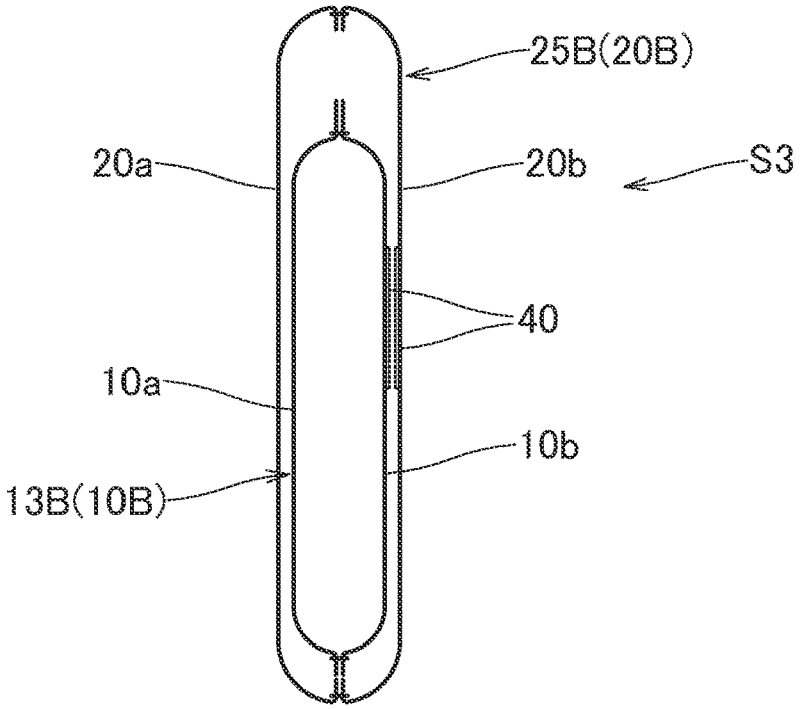
FIG. 10 is a sectional view taken along line X-X of FIG. 9.

The wearable airbag device may be configured like a wearable airbag device S3 depicted in FIGS. 9 and 10. The wearable airbag device S3 has similar configurations to the wearable airbag device S1 of the foregoing embodiment except in including a slippage-preventing surface 40 each in the airbag 10B and outer cover 20B as the slippage-preventing means. One each slippage-preventing surface 40 is disposed in each of the outer surface of the outer wall 10*b* of the airbag 10B and the inner surface of the outer wall 20*b* of the outer cover 20B so the slippage-preventing surfaces 40 face one another. More particularly, the slippage-preventing surfaces 40 of the airbag 10B and outer cover 20B are disposed in regions that overlap with one another in the airbag 10B and cover bag 20B as laid flat. In this specific embodiment, the slippage-preventing surface 40 is located substantially at the center in a front and rear direction and in a up and down direction of each of the protecting inflatable portion 13B and covering portion 25B. Each of the slippage-preventing surfaces 40 is formed by applying, on the outer surface of the outer wall 10*b* of the airbag 10B and inner surface of the outer wall 20*b* of the outer cover 20B, such a material that has greater frictional resistance than that of the woven fabric forming the outer wall 10*b* of the airbag 10B and outer wall 20*b* of the outer cover 20B, specifically such a material as rubber including synthetic rubber and natural rubber.

With this configuration, the slippage-preventing surfaces 40 that are disposed in the regions of the airbag 10B and outer bag 20B which face one another prevent the airbag 10B and outer bag 20B from slipping from one another in position during dressing. This effect is obtained only by storing the airbag 10B inside the outer cover 20B, thus it is not necessary to couple the airbag 10B and outer cover 20B together with a means for connecting or an interlocking means.

Figure 11:
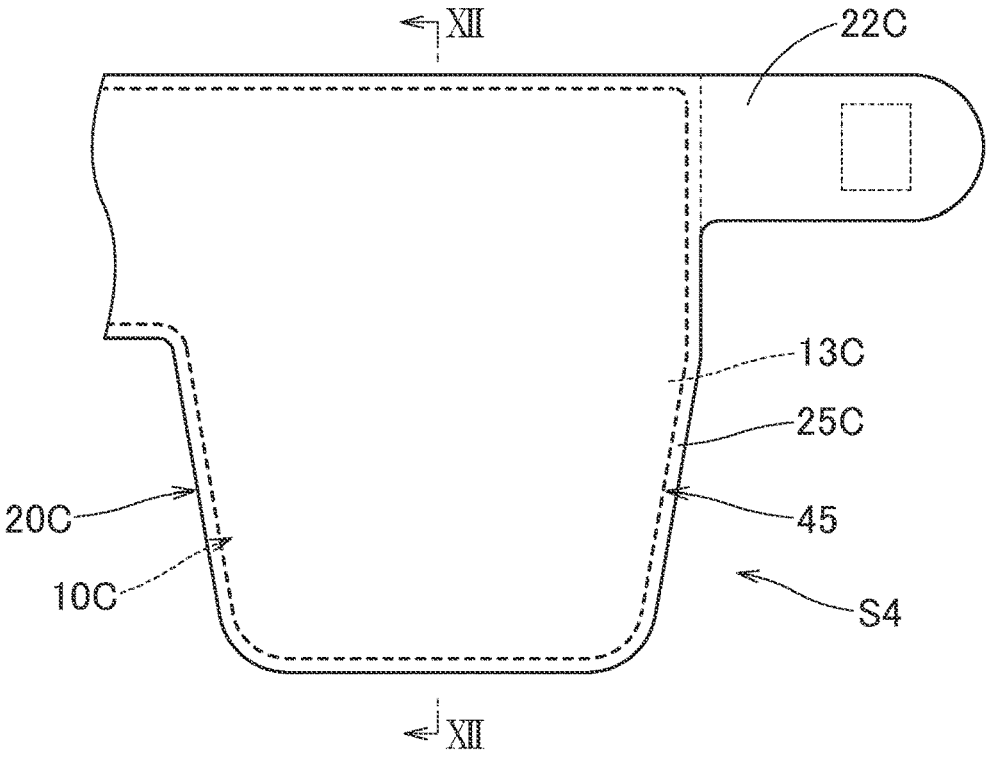
FIG. 11 is a partial enlarged plan view of a wearable airbag device in accordance with yet another alternative embodiment as laid flat.
Figure 12:
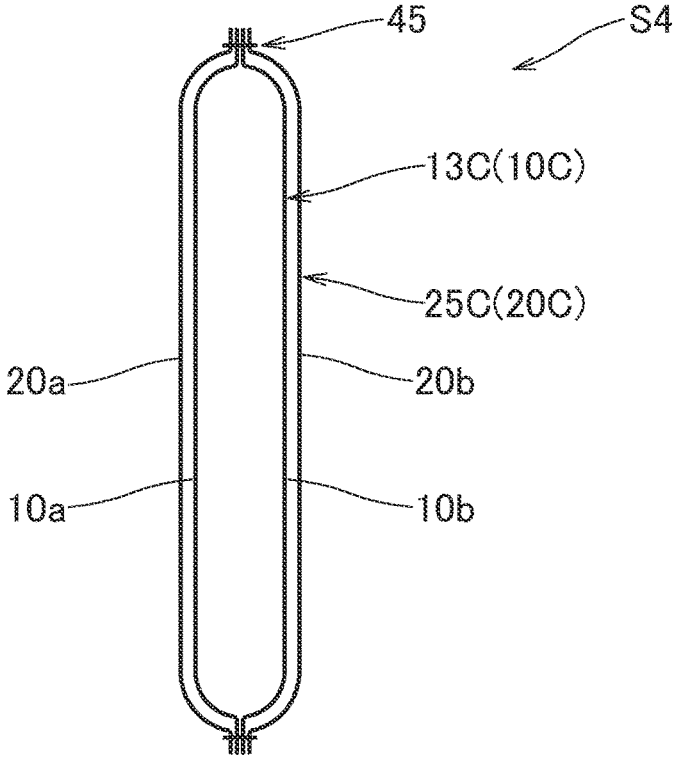
FIG. 12 is a sectional view taken along line XII-XII of FIG. 11.

The wearable airbag device may be configured like a wearable airbag device S4 depicted in FIGS. 11 and 12. In the wearable airbag device S4, the inner wall 10*a* and outer wall 10*b* of the airbag 10C and the inner wall 20*a* and outer wall 20*b* of the outer cover 20C have a substantially identical outer shape except the opposite end regions of the wrap portion 22C, and the inner wall 10*a*, outer wall 10*b*, inner wall 20*a* and outer wall 20*b* are sewn together by the outer circumferential edges. The seam 45 that sews and joins the airbag 10C and outer cover 20C together constitutes the slippage-preventing means.

This slippage-preventing means is simple in configuration and cost-saving because it is formed in the production process of the airbag 10C and outer cover 20C. Although the airbag 10C is sewn together with the outer cover 20C by the entire outer circumference, it is also conceivable that the outer circumferential edges of the airbag and outer cover are sewn together only in part.

The wearable airbag device may be configured like a wearable airbag device S5 depicted in FIGS. 13 to 16. The wearable airbag device S5 includes an airbag 50, an outer cover 60 that covers an outer circumference of the airbag 50, a not-shown gas generator, and a not-shown operation control device. Also in the wearable airbag device S5, the airbag 50 is disposed inside the outer cover 60 in a developed or unfolded state.

Figure 13:
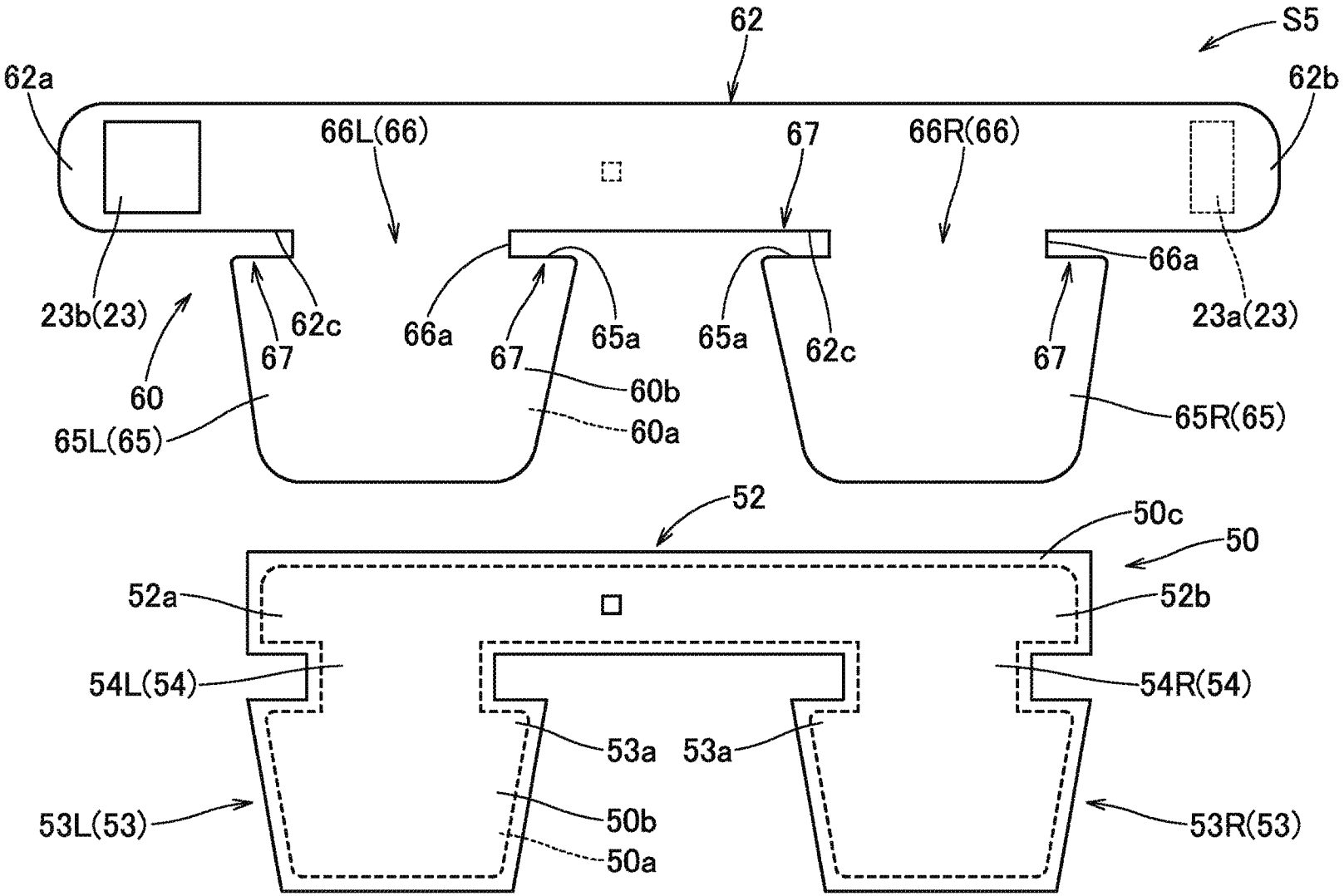
FIG. 13 depicts an outer cover and an airbag for use in a wearable airbag device in accordance with yet another alternative embodiment in plan.
Figure 14:
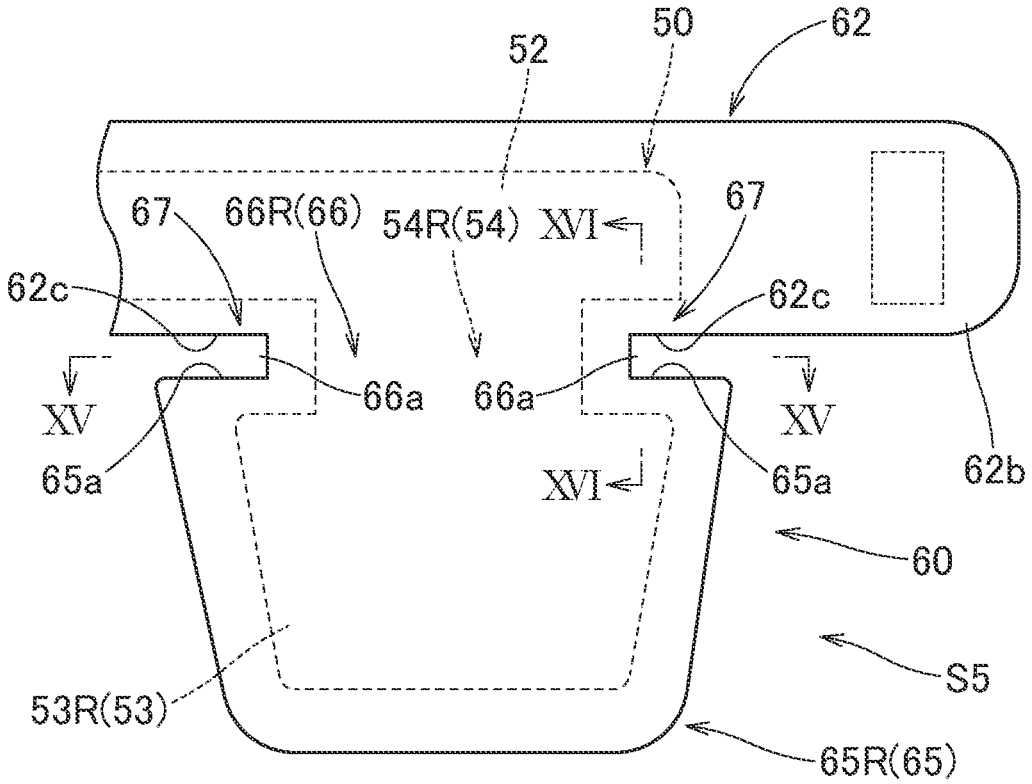
FIG. 14 is a partial enlarged plan view of the wearable airbag device of FIG. 13 as laid flat.
Figure 15:
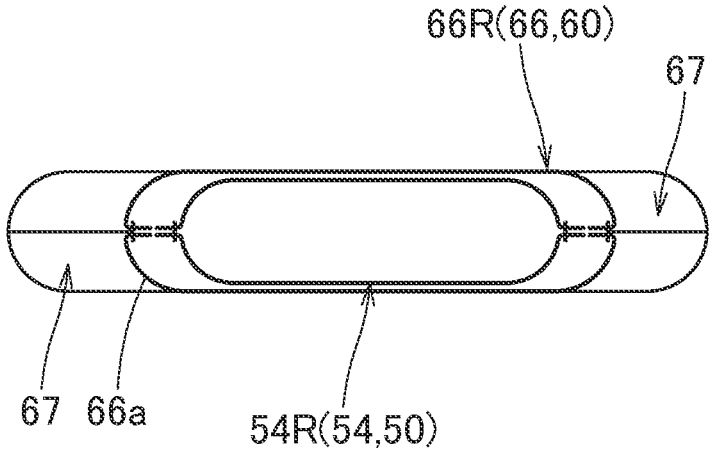
FIG. 15 is a sectional view taken along line XV-XV of FIG. 14.
Figure 16:
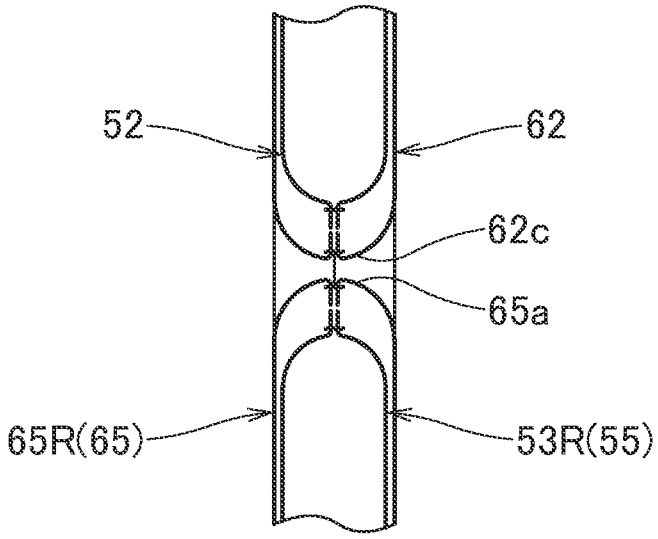
FIG. 16 is a sectional view taken along line XVI-XVI of FIG. 14.

As can be seen in FIG. 13, similarly to the airbag 10 described above, the airbag 50 includes an inner wall 50*a* that is configured to be disposed towards the wearer M (i.e. in the inner side) when worn, and an outer wall 50*b* that is substantially identical to the inner wall 50*a* in outer shape and configured to be disposed on the outer side when worn, and is formed into a bag inflatable into a substantially board shape by sewing (joining) circumferential edges of the inner wall 50*a* and outer wall 50*b* together. The airbag 50 of this embodiment includes two protecting inflatable portions 53 (53L, 53R) for covering left and right sides of the hip MW of the wearer M at airbag deployment, a gas-feeding path 52 that is connected with the not-shown gas generator for feeding an inflation gas to both of the protecting inflatable portions 53, and two communicating portions 54 (54L, 54R) each of which provides gas communication between the protecting inflatable portions 53L/53R and the gas-feeding path 52. The gas-feeding path 52 is arranged along the upper end 50*c* of the airbag 50 over a substantially entire length in a left and right direction of the airbag 50, and is configured to be inflated substantially into a rod shape elongated in the left and right direction. Each of the protecting inflatable portions 53 (53L, 53R) is located below the left end 52*a* region/right end 52*b* region of the gas-feeding path 52, and is formed substantially into a trapezoid that narrows slightly toward the lower end, in a flattened state. Each of the communicating portions 54 (54L, 54R) is configured to provide gas communication between an upper end 53*a* region of the protecting inflatable portion 53L/53R and the left end 52*a* region/right end 52*b* region of the gas-feeding path 52. Each of the communicating portions 54 has a narrower width than the upper end region 53*a* of each of the protecting inflatable portions 53, and extends upward from a vicinity of the center in the width direction of each of the protecting inflatable portions 53. The gas-feeding path 52 protrudes farther outwardly in the left and right direction than the communicating portions 54 in the airbag 50 as laid flat. That is, in the airbag 50 of this embodiment, each of the communicating portions 54 having a narrower width than the protecting inflatable portion 53 and the gas-feeding path 52 is disposed between the protecting inflatable portion 53 and the gas-feeding path 52. Further in other words, in the airbag 50 of this embodiment, the protecting inflatable portion 53 and gas-feeding path 52 teach a "great-width portion") that have greater width than the communicating portion 54 (a "narrow-width portion") are disposed on and beneath the narrow communicating portion 54. In this embodiment, each of the communicating portions 54 serves as a narrow-width portion and constitutes the slippage-preventing means.

Similarly to the outer cover 20 of the wearable airbag device S1 described above, the outer cover 60 is made of a flexible woven fabric having better touch than the base cloths of the airbag 50. The outer cover 60 includes an inner wall 60*a* that is disposed in the inner side (i.e. towards the wearer M) when worn, and an outer wall 60*a* that is substantially identical to the inner wall 60*b* in outer shape and disposed on the outer side when worn, and is formed into a bag by joining (or sewing) outer circumferential edges of the inner wall 60*a* and outer wall 60*b* together. Referring to FIG. 13, the outer cover 60 includes a wrap portion 62 that is substantially band-shaped and located in a vicinity of the upper edge of the outer cover 60, two storing portions 65 (65L, 65R) each of which stores the protecting inflatable portion 53L/53R, and two connecting portions 66 (66L, 66R) each of which is located between the wrap portion 62 and the storing portion 65L/65R and stores the communicating portion 54L/54R. Similarly to the outer cover 20 of the wearable airbag device S1 described above, the wrap portion 62 includes, at the opposite ends 62*a*, 62*b*, a surface fastener or hook-and-loop fastener 23 serving as a placing means.

Each of the storing portions 65 as laid flat has such a shape that is substantially similar to and greater than that of each of the protecting inflatable portions 53 so as to allow the protecting inflatable portion 53 to inflate smoothly there inside. Each of the connecting portions 66 has such a width that is able to store the communicating portion 54 as laid flat and narrower than the protecting inflatable portion 53 as laid flat. In this embodiment, the airbag 50 as stored inside the outer cover 60 is prevented from being dislocated with respect to the outer cover 60 by the storing of the communicating portions 54 inside the connecting portions 66. A peripheral region 67 in the outer cover 60 that is disposed in a periphery of each of the communicating portions 54, i.e. a peripheral region 66*a* of the connecting portion 66 including the lower edge 62*c* of the wrap portion 62 and upper edge 65*a* of the storing portion 65, constitutes a retaining portion that retains an outer circumference of the communicating portion (as the narrow-width portion) 54 of the airbag 50 stored inside the outer cover 60.

In the wearable airbag device S5 configured as described above, each of the communicating portions (i.e. the narrow-width portions) 54 of the airbag 50 which is constricted between the protecting inflatable portion 53 and gas-feeding path 52 is stored inside the connecting portion 66 of the outer cover 60 which is correspondingly narrower than surroundings in order to be retained by the peripheral region (i.e. the retaining portion) 67 of the connecting portion 66. This configuration will prevent the airbag 50 as stored inside the outer cover 60 from being dislocated with respect to the outer cover 60 when put on the wearer, and will also prevent the airbag 50 from being dislocated inside the outer cover 60 when the wearer wearing the airbag device S5 moves.

Figure 17:
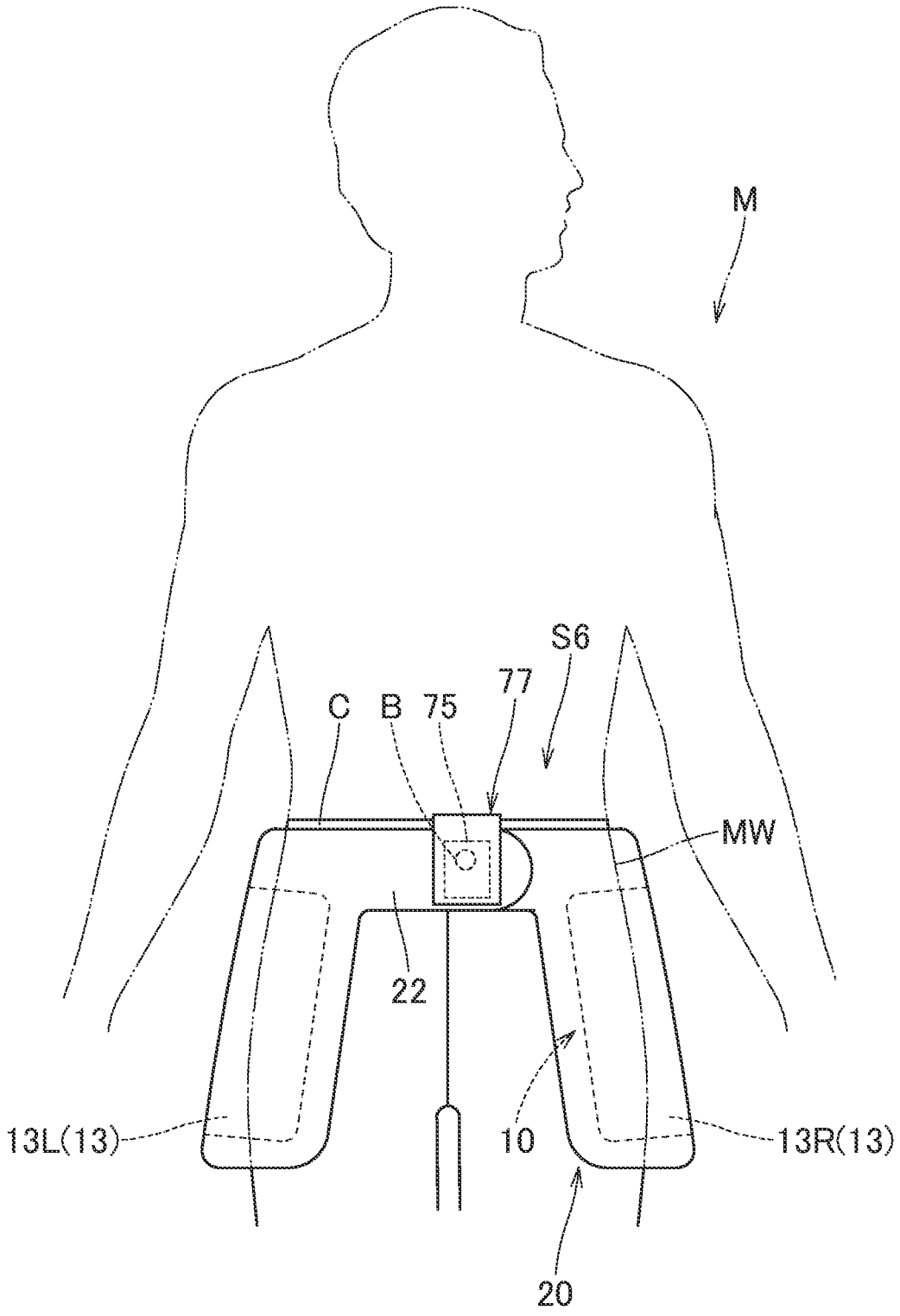
FIG. 17 schematically depicts a wearable airbag device in accordance with yet another alternative embodiment as worn by a wearer.
Figure 18:
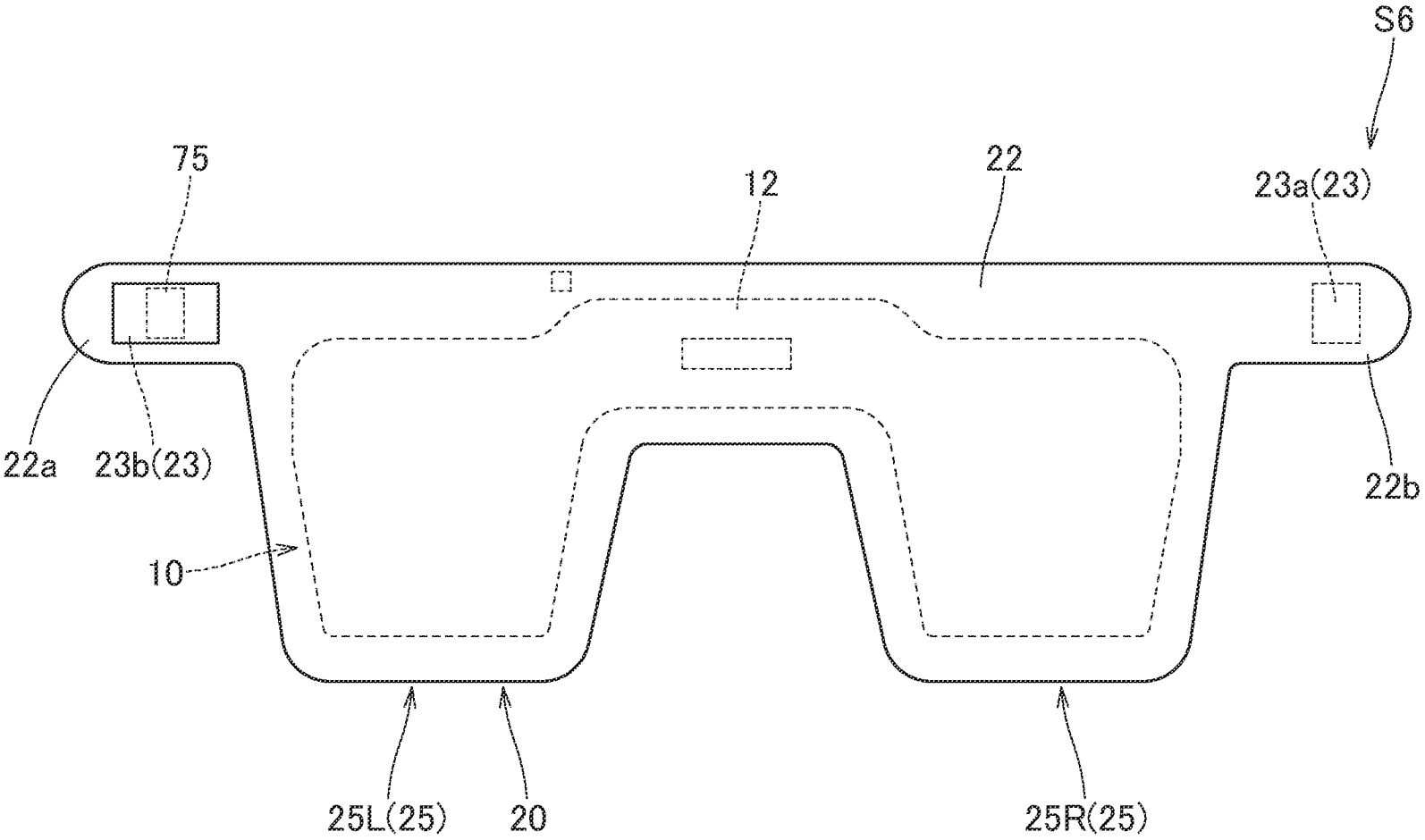
FIG. 18 is a plan view of the wearable airbag device of FIG. 17 as laid flat.
Figure 19:
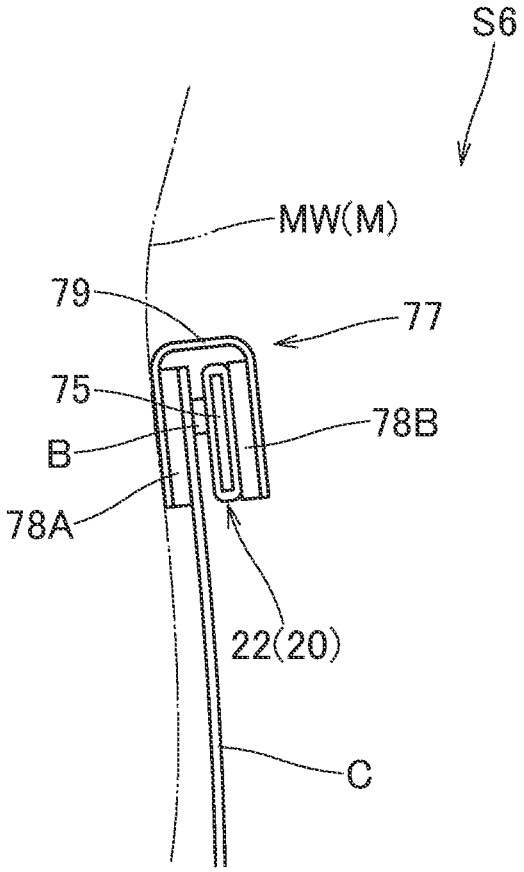
FIG. 19 is a schematic partial enlarged sectional view showing a vicinity of a mounting means for use in the wearable airbag device of FIG. 17 as worn by a wearer.

The wearable airbag device may be configured like a wearable airbag device S6 depicted in FIGS. 17 to 19. The wearable airbag device S6 has the same configurations as the wearable airbag device S1, and includes an additional slippage-preventing means. The additional slippage-preventing means includes a mount-site marker that is disposed on the part of the wearer M, a loop-side surface 23*b* of the hook-and-loop fastener 23 disposed on the part of the airbag 10 as a bag-side marker, and a mounting means 77 for mounting the airbag 10 on the body of the wearer M. In this embodiment, the button B of the clothing C the wearer M wears serves as the mount-side marker. In the first end 22*a* of the wrap portion 22 of the outer bag 20, there is disposed a metal plate 75 inside of or underneath the loop-side surface 23*b* of the hook-and-loop faster 23. The metal plate 75 is formed from a material that is attracted to later-described magnets 78A, 78B. The airbag device S6 is configured to be put on the wearer M by arranging the wrap portion 22 of the outer cover 20 around the hip MW with the loop-side surface (i.e. bag-side marker) 23*b* aligned with the button B (i.e. mount-site marker) of the clothing C in position, and mounting the airbag 10 (the outer cover 20, in this embodiment) on the body of the wearer M with the use of the mounting means 77.

The mounting means 77 is configured to mount the airbag 10 (outer cover 20) on the part of the wearer M by sandwiching or clamping the clothing (trouser, by way of example) C of the wearer M and opposite end regions of the wrap portion 22 (where the hook-and-loop faster 23 and the metal plate 75 are located) of the airbag device S6 as worn by the wearer M. The mounting means 77 includes a clamping portion 79 and two magnets 78A, 78B that are disposed at opposite ends of the clamping portion 79. When sandwiched by the clamping portion 79, the metal plate 75 positioned on the loop-side surface (i.e. the bag-side marker) 23*b* is attracted to the magnets 78A, 78B. That is, the wearable airbag device S6 as worn by the wearer is prevented from being dislocated with respect to the clothing C of the wearer M if it is put on by arranging the outer cover 20 around the hip MW with the loop-side surface (i.e. bag-side marker) 23*b* aligned with the button B (i.e. mount-site marker) in position, and by sandwiching the clothing C (or button B) and the metal plate 75 covered by the outer cover 20 (wrap portion 22) with the mounting means 77.

The wearable airbag device S6 as worn stays in position with little fear of dislocation with respect to the wearer M. In the wearable airbag device S6, especially, the airbag 10 (the wrap portion 22 of the outer cover 20, actually) is configured to be mounted on the part of the wearer M with the use of the mounting means 77 including the magnets 78A, 78B. This configuration will facilitate positioning of the airbag 10 (outer cover 20) with respect to the wearer M as well as taking on and off of the airbag 10 with the use of magnetic force of a magnetic body (i.e. magnet). Other than the button B, a buckle of a belt used by the wearer M may also be used as the mount-site marker, by way of example. The mounting means may alternatively be composed of a plate which is formed of a magnetic body disposed inside of or underneath the hook-and-loop fastener as the bag-side marker. In this case, if the plate adsorbs the buckle, the mount-site marker is aligned with the bag-side marker in position as well as the airbag is mounted on the part of the wearer.

With the wearable airbag devices S1 to S6 in the foregoing embodiments, the two protecting inflatable portions 13, 13A, 13B, 13C, 53 of the airbags 10, 10A, 10B, 10C, 50 are able to protect vicinities of bases of the femurs TB (i.e. the trochanters TP of femurs) of the wearer M in a steady fashion. Accordingly, the wearable airbag devices S1 to S6 will help prevent fractures of the femur TB that may take a long time to treat, thus will be suitable for use by elderly people.

The wearable airbag devices S1 to S6 in the foregoing embodiments are each configured to be wrapped around the hip MW (pelvis MP) of the wearer M and deploy the airbag 10/10A/10B/10C/50, which is stored inside the outer cover 20/20A/20B/20C/60 in a flattened state, to protect the hip MW (trochanters TP) of the wearer M. However, applications of the invention should not be limited to those disclosed in the present disclosure. The invention may also be applied to a wearable airbag device that is configured to be wrapped around the hip (pelvis) and includes an airbag which is stored in an outer cover in a folded configuration. The invention may also be applied to a wearable airbag device that is adapted to be worn on a torso of the wearer like a vest, jacket and so on and configured to deploy an airbag from the lower side as worn for protecting the hip, or a wearable airbag device that is configured to deploy an airbag from the upper side as worn for protecting the head.

The exemplary embodiment of the present disclosure relates to a wearable airbag device that is adapted to be worn by a wearer for protecting one or more targeted body parts of the wearer. The airbag device includes: an airbag that is formed of a sheet material having flexibility, the airbag including one or more protecting inflatable portions each of which is configured to be inflated with an inflation gas and to cover one of the one or more targeted body parts; and a means for preventing each of the one or more protecting inflatable portions from being dislocated from the targeted body part at airbag deployment.

With the wearable airbag device in accordance with the exemplary embodiment, since the means for preventing prevents each of the protecting inflatable portions of the airbag from being dislocated from the targeted body part, the protecting inflatable portions cover and protect the targeted body parts accurately and adequately.

Therefore, the wearable airbag device in accordance with the exemplary embodiment is able to protect the targeted body parts adequately at airbag deployment by preventing the airbag from being dislocated with respect to the wearer.

In one or more embodiments, the wearable airbag device may further include an outer cover that covers an outer circumference of the airbag and is formed of a sheet material having flexibility. The outer cover includes a means for placing the airbag device on the body of the wearer. The means for preventing is configured to prevent the airbag from being dislocated with respect to the outer cover.

The means for preventing configured as described above will enable the wearable airbag device to be put on the wearer in a state in which the airbag is prevented from being dislocated with respect to the outer cover. The means for preventing configured as described above will also prevent the airbag from being dislocated inside the outer cover when the wearer wearing the airbag device moves. Moreover, since the airbag is covered by the outer cover by the outer circumference, the wearable airbag device as worn has a good external appearance.

In one or more embodiments, the means for preventing may be composed of a means for connecting one or more predetermined portions of the airbag to the outer cover while fixing the one or more predetermined positions in position in the outer cover.

In one or more embodiments, the means for connecting may include: one or more through holes disposed in the airbag, each of the one or more through holes going through an uninflatable portion of the airbag; and one or more passing members disposed in the outer cover, each of the one or more passing members being passed through corresponding one of the one or more through holes and fixing a peripheral region of the through hole in position. With this configuration, if each of the passing members disposed in the outer cover is passed through the corresponding one of the through holes in the airbag, the peripheral region of the through hole is fixed in position, i.e. the airbag is fixed in position with respect to the outer cover. The above configuration will facilitate this connecting work.

In one or more embodiments, the means for connecting may be composed of a pair of interlockable parts that are respectively disposed on an outer surface of the airbag and an inner surface of the outer cover, and are interlockable with one another. By making the interlockable parts interlocked with one another, the airbag will be fixed in position with respect to the outer cover easily.

In one or more embodiments, the means for connecting may be located at a position remote from a central region of each of the protecting inflatable portions of the airbag. Such means for connecting is able to position and connect the airbag to the outer cover without affecting the protecting performance of the airbag at protecting the targeted body parts.

In one or more embodiments, the means for preventing may be composed of a first slippage-preventing surface and a second slippage-preventing surface that have great frictional resistance and are respectively disposed in an outer surface of the airbag and in an inner surface of the outer cover. The first slippage-preventing surface and second slippage-preventing surface are located at regions of the airbag and outer cover that face one another so that the airbag and outer cover are prevented from slipping from one another in position due to the frictional resistance between the first and second slippage-preventing surfaces. The slippage-preventing surfaces will prevent the airbag and outer bag from slipping from one another in position during dressing. This effect is obtained only by storing the airbag inside the outer cover, thus it is not necessary to couple the airbag and outer cover together with a means for connecting or a pair of engageable parts.

In one or more embodiments, as the means for preventing, the airbag and the outer cover may be sewn together by the outer circumferential edges at least in part. This is simple in configuration and cost-saving because the means for preventing is formed in the production process of the airbag and outer cover.

In one or more embodiments, the means for preventing may be configured as follows: An inflatable portion of the airbag includes a narrow-width portion and two great-width portions that are disposed on opposite sides of the narrow-width portion, each of the great-width portions having a greater width than the narrow-width portion. The outer cover includes a retaining portion that is configured to retain an outer circumference of the narrow-width portion. The narrow-width portion and the retaining portion constitute the means for preventing.

In one or more embodiments, the means for preventing may be configured to include: a mount-site marker that is disposed on the part of the wearer; a bag-side marker that is disposed in the airbag and corresponds to the mount-site marker; and a means for mounting the airbag on the part of the wearer with the mount-site marker aligned with the bag-side marker in position. This configuration will enable the wearable airbag device to be put on the wearer while preventing the airbag from being dislocated with respect to the wearer.

Specifically, the means for mounting may be configured to mount the airbag on the part of the wearer utilizing adsorptive force of magnet. This configuration will facilitate positioning of the airbag with respect to the wearer as well as taking on and off of the airbag with the use of the adsorptive force of the magnet.

What is claimed is:

1. A wearable airbag device that is adapted to be worn by a wearer for protecting one or more targeted body parts of the wearer, the airbag device comprising: an airbag that is formed of a sheet material having flexibility, the airbag including one or more protecting inflatable portions each of which is configured to be inflated with an inflation gas and to cover one of the one or more targeted body parts; and an outer cover that covers an outer circumference of the airbag, the outer cover is formed of a sheet material having flexibility and the outer cover including a fastener configured to allow attachment of the airbag device around the body of the wearer;

wherein:

an inflatable portion of the airbag includes a narrow-width portion and two great-width portions that are disposed on opposite sides of the narrow-width portion, each of the great-width portions having a greater width than the narrow-width portion;

the outer cover includes a retaining portion that is configured to retain an outer circumference of the narrow-width portion;

the narrow-width portion and the retaining portion are configured to prevent each of the one or more protecting inflatable portions from being dislocated with respect to the outer cover, and are configured to prevent each of the one or more protecting inflatable portions from being dislocated from the one or more targeted body parts at airbag deployment; and the airbag and the outer cover are separable from each other.

2. The wearable airbag device of claim 1, wherein:

the airbag device is configured to be wrapped around a hip of the wearer; and the airbag includes two protecting inflatable portions that are configured to cover a left and a right side of the hip of the wearer as the one or more targeted body parts at airbag deployment.

3. The wearable airbag device of claim 1, wherein:

the one or more protecting inflatable portions comprises two protecting inflatable portions, wherein the airbag includes a gas-feeding path for feeding the inflation gas to both of the two protecting inflatable portions, and the airbag further includes two communicating portions each of which provides gas communication between the two protecting inflatable portions and the gas-feeding path;

each of the two communicating portions comprises the narrow-width portion, the narrow-width portion further comprising a narrower width than an upper end region of each of the two protecting inflatable portions; and the gas-feeding path protrudes farther outwardly in a left and a right direction within the upper end region of the airbag than each of the two communicating portions within each of the two connecting portions of the airbag when the airbag is laid flat.

4. The wearable airbag device of claim 3, each of the protecting inflatable portions being located below a respective narrow-width portion which is located below a respective left region and a right region of the gas-feeding path, and each of the protecting inflatable portions being formed into a trapezoidal shape that narrows toward a lower end of each of the protecting inflatable portions, in the airbag when the airbag is laid flat.

* * * * *